US007739751B2

(12) United States Patent
Lin

(10) Patent No.: US 7,739,751 B2
(45) Date of Patent: Jun. 22, 2010

(54) CONNECTING AND RETAINING STRUCTURE FOR A SHOE COVERING AND TROUSER LEG COMBINATION

(76) Inventor: Che-Wen Lin, P.O. Box No. 6-57, Junghe, Taipei 235 (TW)

( * ) Notice: Subject to any disclaimer, the term of this patent is extended or adjusted under 35 U.S.C. 154(b) by 1213 days.

(21) Appl. No.: 11/315,009

(22) Filed: Dec. 23, 2005

(65) Prior Publication Data

US 2006/0096008 A1 May 11, 2006

(51) Int. Cl.
*A41D 1/06* (2006.01)

(52) U.S. Cl. ..... 2/227; 2/232

(58) Field of Classification Search ..... 2/242, 2/239, 240, 241, 79, 227, 22–23, 61, 232; 36/2 R, 10

See application file for complete search history.

(56) References Cited

U.S. PATENT DOCUMENTS

| | | | | |
|---|---|---|---|---|
| 519,670 | A | 5/1894 | Gassaway | |
| 1,031,719 | A | 7/1912 | Kurz et al. | |
| 1,479,707 | A | 1/1924 | Foisy | |
| 1,515,149 | A | 11/1924 | Cohen | |
| 1,596,085 | A | 8/1926 | Downes | |
| 1,664,309 | A | 3/1928 | Mueller | |
| 1,783,505 | A | 12/1930 | Hayes | |
| 1,825,197 | A | 9/1931 | McGinnis | |
| 2,073,485 | A | 3/1937 | Knowling | |
| 2,659,086 | A | 11/1953 | McGrath | |
| 2,959,788 | A | 11/1960 | Justad | |
| 3,147,491 | A | 9/1964 | Fisch | |
| 3,311,924 | A | 4/1967 | Roark | |
| 3,389,407 | A | 6/1968 | Morrison | |
| 4,244,121 | A | 1/1981 | Adams | |
| 4,390,996 | A | 7/1983 | Reed | |
| 4,773,100 | A * | 9/1988 | Kuo | 2/46 |
| 5,611,082 | A | 3/1997 | Bull | |
| 5,642,573 | A * | 7/1997 | Brown | 36/2 R |
| 5,815,948 | A | 10/1998 | Dzielak | |
| 6,199,217 | B1 * | 3/2001 | Mooney | 2/240 |
| 6,360,371 | B1 | 3/2002 | Davey | |
| 6,405,383 | B2 | 6/2002 | Heller et al. | |
| 6,427,242 | B1 | 8/2002 | Bush et al. | |
| 6,851,203 | B2 * | 2/2005 | Roelofs | 36/1.5 |

* cited by examiner

*Primary Examiner*—Tejash Patel

(57) ABSTRACT

A connecting and retaining structure for a shoe covering and trouser leg combination includes a connecting portion, a retaining portion, an extension portion, a position fixing portion and a shoe covering, and is capable of covering of the leg portion of a user against rain. A periphery of the retaining portion forms a covering that enables the extension portion and the shoe covering to be retained therein. The shoe covering is joined to a lower end of the extension portion, and is provided with an opening, through which the shoe covering and the extension portion can be rolled up and then disposed within the retaining portion. The extension portion adopts a flexible soft lining having length longer than the connecting portion, and provides an allowance for displacement and extension of the legs of the user when wearing the shoe coverings, thereby enabling unhindered large extending movements of the legs.

18 Claims, 14 Drawing Sheets

CONNECTING AND RETAINING STRUCTURE FOR A SHOE COVERING AND TROUSER LEG COMBINATION

BACKGROUND OF THE INVENTION (a) Field of the Invention

The present invention relates to a connecting and retaining structure for a shoe covering and trouser leg combination, and more particularly to a unique connecting and retaining structural design that is able to accommodate the extension and contraction of legs, whereby shoe coverings can be removed from connected retaining portions and worn over the feet of the user, thereby achieving effectiveness of protecting the feet against rain, and providing comfort and flexibility when the legs are in an extended or contracted state.

(b) Description of the Prior Art

The inexpensive price, high mobility and convenience of bicycles and motorcycles have made them an indispensable means of transport for the general public in developing countries. However, when compared to automobiles or other general public means of transport, their main shortcoming is that although a raincoat and rain shoes can be worn to protect the rider from rain to a certain extent, they are not able to completely keep out the wind and rain. For example: when wearing a raincoat in a light rainfall that suddenly turns into a down-pour, if the rain shoes are not put on in time, not only are the shoes and socks of the person completely soaked, but also the rainwater collects in the shoes.

Referring to FIG. 1, which shows a prior art rainwear, wherein a cape raincoat 10 is directly fitted over the body of the user, and, usually, it is not necessary to wear rain pants. Referring to FIG. 2, which shows another type of prior art rainwear, wherein a two-piece rainwear 20 includes an top rain jacket 21 and rain pants 22, which are worn separately over the top half and bottom half of the user's body respectively. In addition, FIGS. 1 and 2 show rain shoe coverings 30, which can be directly fitted over the shoes or boots worn by a user for use together with the rainwear.

Neither of the aforementioned rainwear depicted in FIGS. 1 and 2 can be connected to the rain shoe coverings 30 and used in combination, mainly because if the shoe coverings 30 and rainwear are unwillingly connected or fastening devices are used to join the shoe coverings 30 to the cape raincoat 10 or the rain pants 22, then putting on and taking off of the shoe coverings-rainwear combination is extremely inconvenient, more particularly, in light rain conditions, when it is not necessary to wear the shoe coverings 30, the shoe coverings 30 connected to the cape raincoat 10 or a lower end of the rain pants 22 will cause inconvenience to the user when moving around. Moreover, such shoe coverings-rainwear combinations are unable to achieve automatic freely adjustable effectiveness when wearing. Because length of leg coverings needed when the legs of a user riding a motorcycle are bent is relatively longer than when the user is in a standing position, thus, a pulling effect naturally occurs on the leg coverings that have already been pre-adjusted to an appropriate length when the user was in a standing position, which causes the shoe coverings to assume a stretched taut state. Hence, the cape raincoat 10 or the two-piece rainwear 20 for sale in the present market are both sold separate from the shoe coverings 30, and thus must be purchased separately by the user. Moreover, even if the shoe coverings 30 are purchased at the same time as the cape raincoat 10 or the two-piece rainwear 20, the user is unable to join the shoe coverings 30 to the cape raincoat 10 or the rain pants 22 for use together.

Hence, the prior art rainwear cannot be joined to rain shoe coverings for use together, which not only results in the aforementioned inconvenience in putting on, taking off and in moving around when wearing, but also includes the following shortcomings:

1. The rainwear and shoe coverings are sold as two separate, different products, which add to the expenditure the consumer must incur.

2. Because the shoe coverings are not connected to the rainwear, thus, there is the problem of storage, and the user often cannot find one of the items, and, sometimes, cannot even find one of the rain shoe coverings.

3. Wearing the prior art rainwear is adequate when leaving to go outside and ride a bicycle or motorcycle in light rain. However, when the light rain suddenly turns into a heavy downpour, if the shoe coverings are not put on in time, the shoes and socks of the user are completely drenched. If the user wants to put on the shoe coverings, then he must stop by the roadside and then find and put on the shoe coverings. Such a procedure is slow, and temporarily parking by the roadside can cause a traffic jam and is dangerous.

4. When the motorcyclist has put on the rainwear and the shoe coverings and is traveling along the road, his two legs are bent with his feet on the stances of the motorcycle. Hence, the lower end of the rainwear covers the tops of the shoe coverings, and although providing minimum protection against the rain, however, when stopping at a red light, the two legs must be stretched for the two feet to touch the ground in order to support the weight of the motorcycle. However, because the rainwear and the shoe coverings are not connected, thus, the two stretched legs cause a gap to form between the lower end of the rainwear and the tops of the shoe coverings (see FIG. 1), which enables the rain to directly enter the shoe coverings, thereby soaking the shoes and socks within the shoe coverings.

SUMMARY OF THE INVENTION

The primary objective of the present invention is to provide a connecting and retaining structure for a shoe covering and trouser leg combination that is structured to comprise a connecting portion, a retaining portion, an extension portion, a position fixing portion and a shoe covering, wherein the connecting portion and the extension portion are columnar sheets that are annular joined to an appropriate position of a trouser leg for connecting the shoe covering, thereby enabling the leg portion protruding from the lower end of the trouser leg to be completely covered and protected from the rain. The retaining portion is circumferentially connected to a lower end of the trouser leg, which enables the extension portion, the connecting portion and the shoe covering to be rolled up and disposed within the retaining portion.

Another objective of the present invention is to provide a structure that enables the connecting portion, the retaining portion and an end of the extension portion to be annular joined to an appropriate position of the trouser leg using the position fixing portion. Moreover, an outer periphery of the retaining portion forms a covering, and a retaining space is formed between the connecting portion and the retaining portion that enables the extension portion and the shoe covering to be retained therein. The shoe covering is joined to a lower end of the extension portion, and is provided with an opening, through which the shoe covering and the extension portion can be rolled up and then disposed within the retaining portion. A fixing portion is attached to the retaining portion close to a retaining opening that is used to close and secure the retaining opening, thereby preventing the extension portion and the shoe covering from hanging down and falling out from the retaining opening after being retained within the retaining portion.

A third objective of the present invention is to use flexible soft lining as the extension portion, and the flexible soft lining is slightly longer than the connecting portion, and the retaining space is formed between the connecting portion and the retaining portion. A binding member and a binding component attached to a periphery of the shoe covering joined to a lower end of the soft lining are used to bind the shoe covering around the ankle position of a user, and causes the flexible soft lining having a length longer than the connecting portion to form a curved portion that provides an allowance for displacement and extension of the legs of the user when wearing the shoe coverings, and enables unhindered large extending movements of the legs.

A fourth objective of the present invention is to provide the connecting portion with an open crossover portion, and second male fasteners and second female fasteners attached to the open crossover portion are used to open and close the open crossover portion to facilitate fitting and storing away of the shoe covering.

A fifth objective of the present invention is to provide the shoe covering with a binding member attached to the outer periphery thereof, which is used to fix position of the shoe covering when in use. Moreover, the binding member further includes the binding component, and mutual fastening of the two is used to achieve the objective of fixing the shoe covering.

A sixth objective of the present invention is to provide the shoe covering with third male fasteners and third female fasteners attached to the outer periphery thereof, which are used to achieve the objective to enable adjusting measurements of the shoe covering.

A seventh objective of the present invention is to join the connecting portion and the extension portion to a periphery of the retaining portion at a position of the position fixing portion by means of a movable join method, wherein the connecting portion and the end of the extension portion are fixed, and fourth male fasteners are attached to an inner periphery of the extension portion corresponding to fourth female fasteners attached to an outer periphery of the retaining portion at a position of the position fixing portion. Mutual fastening of the fourth male and female fasteners is used to achieve the objective of movable joining the connecting portion and the extension portion to the retaining portion. Moreover, a flap is attached on top of the position fixing portion to cover a gap formed by the movable joining of the connecting portion, the extension portion to the retaining portion.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
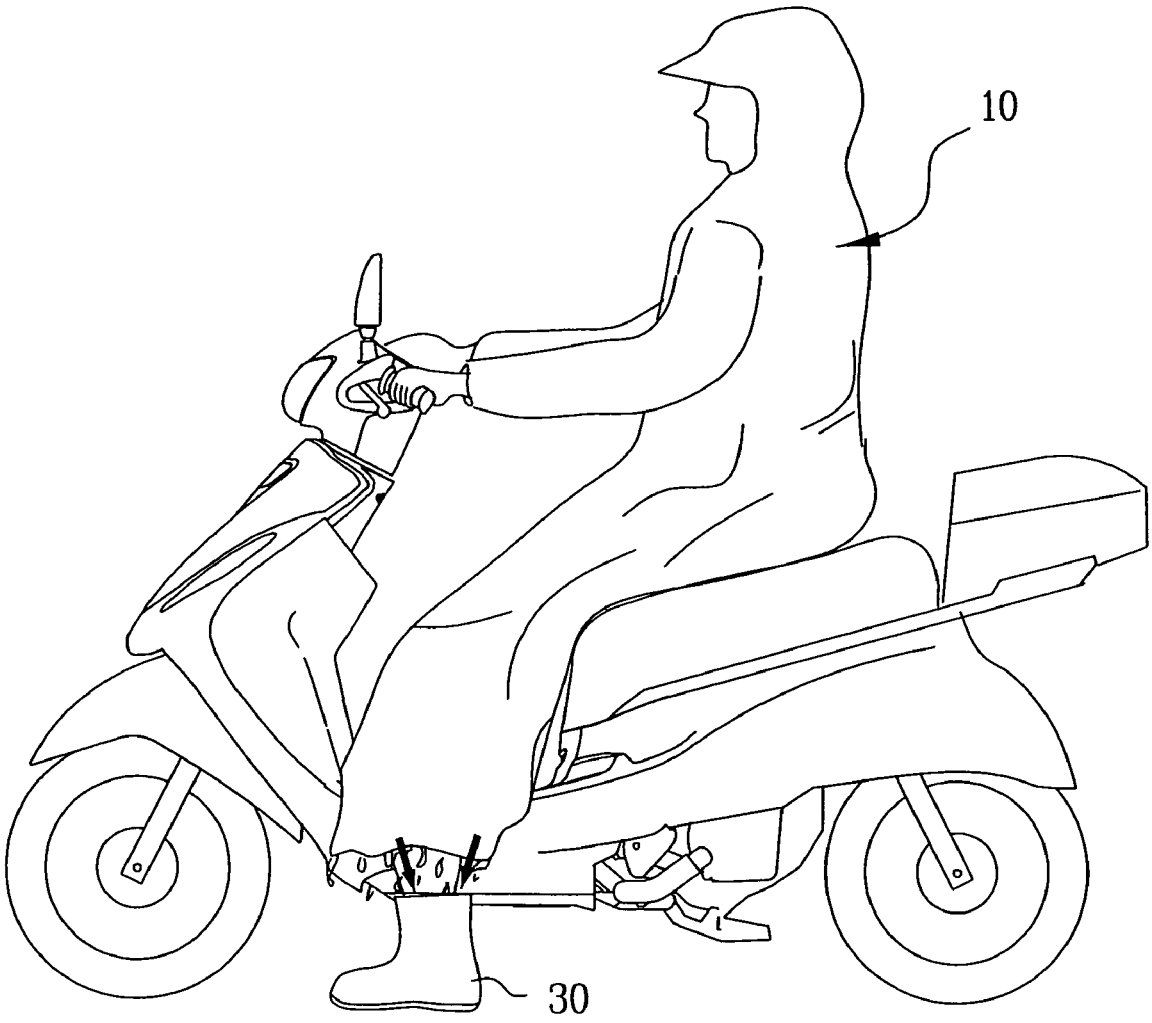
FIG.1 (PRIOR ART)
FIG. 1 shows a schematic view of prior art rainwear and rain shoes worn separately.
Figure 2:
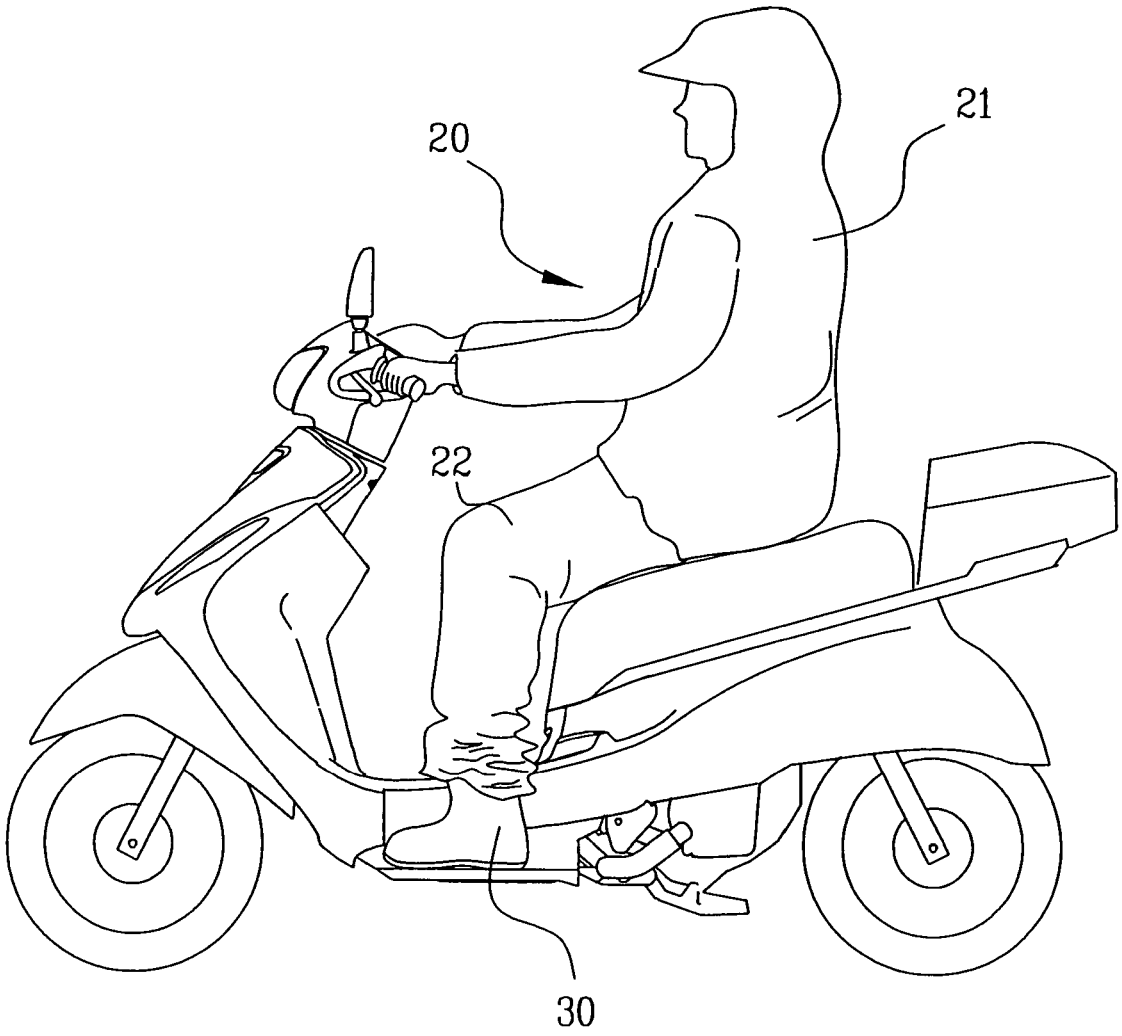
FIG.2(PRIOR ART)
FIG. 2 shows a schematic view of prior art two-piece rainwear rain shoes.
Figure 3:
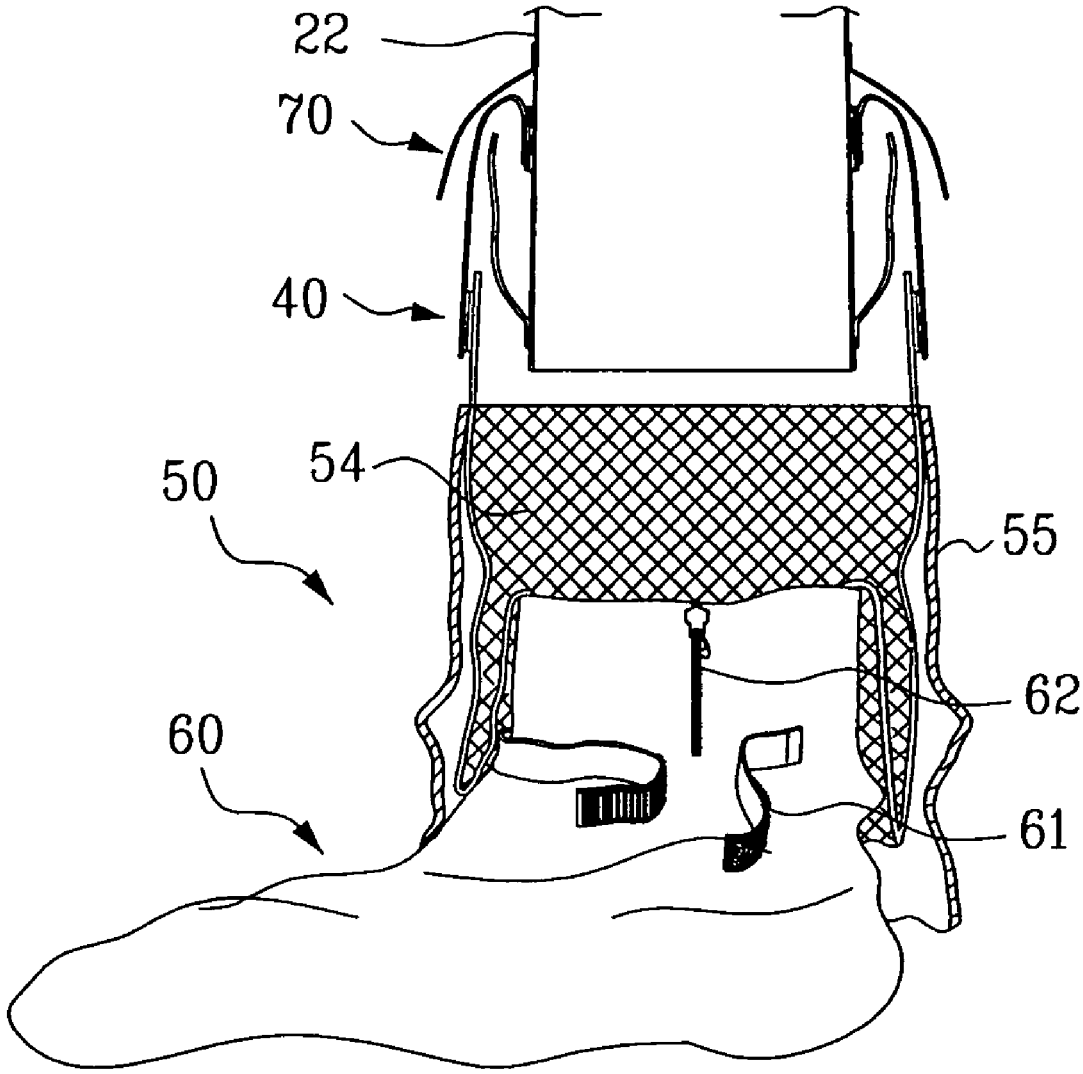
FIG. 3 shows a cross-sectional view of an embodiment depicting a shoe covering after being removed from a retaining portion according to the present invention.
Figure 4:
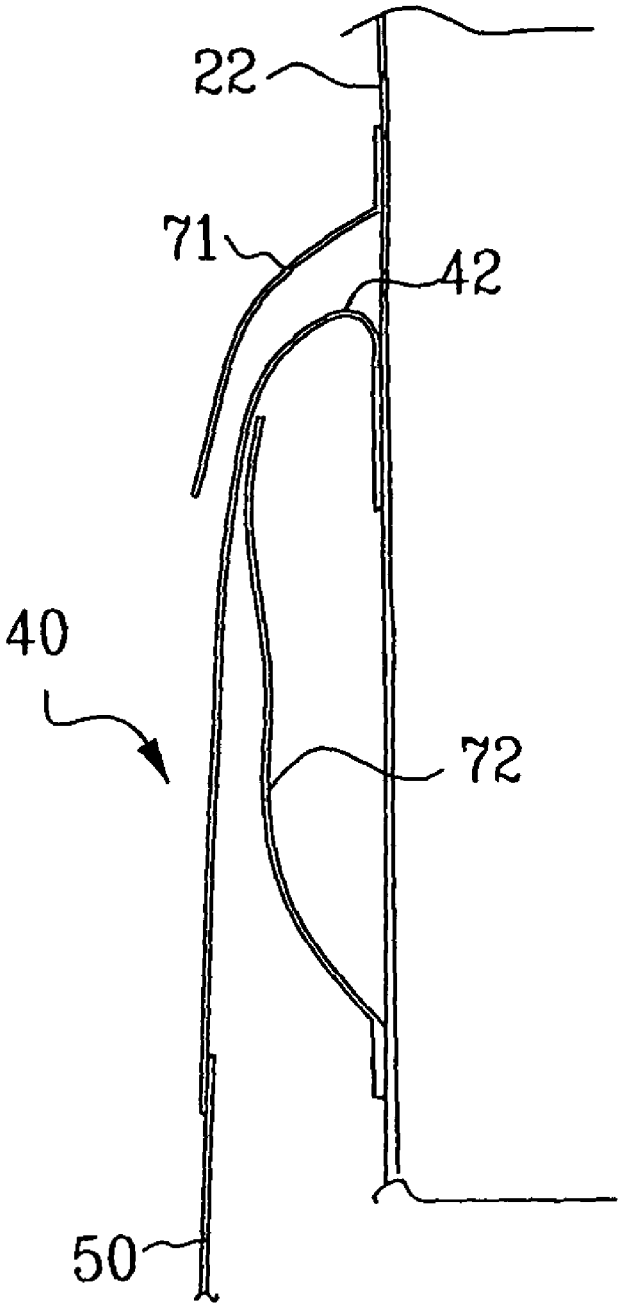
FIG. 4 shows a partial exploded schematic view of an extension portion joined to the retaining portion according to the present invention.
Figure 5:
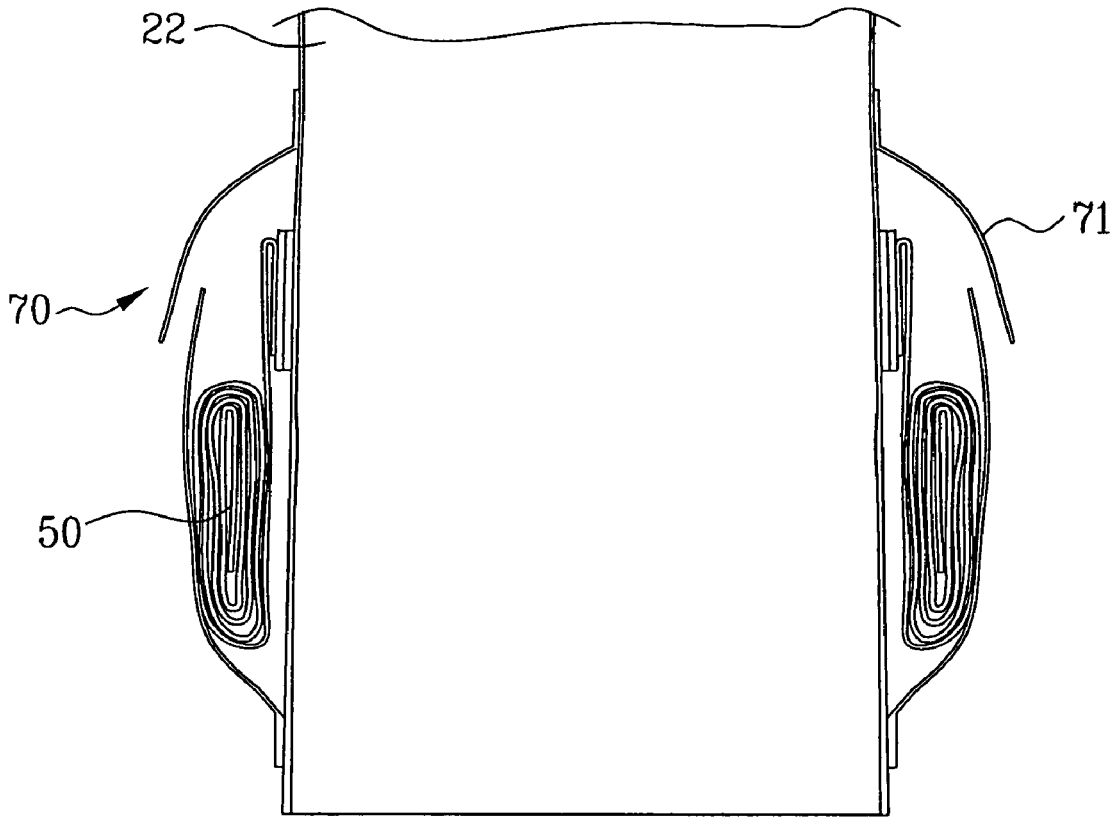
FIG. 5 shows a structural schematic view of an embodiment depicting the shoe covering after being retained within the retaining portion according to the present invention.

Referring to FIGS. 3, 4 and 5, which show a first embodiment of the present invention, comprising a connecting portion 50, a retaining portion 70, an extension portion 40, a position fixing portion 42 and a shoe covering 60, wherein the connecting portion 50 and the extension portion 40 are columnar sheets that are annular joined to an appropriate position of a trouser leg 22 for connecting the shoe covering 60, thereby enabling the leg portion protruding from the lower end of the trouser leg 22 to be completely covered and protected from the rain. The retaining portion 70 is circumferentially connected to a lower end of the trouser leg 22. A pocket opening along the trouser leg 22 assumes a 360 degree circumferential extension that enables the extension portion 40, the connecting portion 50 and the shoe covering 60 to be rolled up and retained within the retaining portion 70. Moreover, the shoe covering 60 connected to a lower end of the extension portion 40 and the connecting portion 50 is designed with an opening 62, from which the user is able to withdraw the sole of his shoe when removing the shoe covering 60.

Referring to FIGS. 4 and 5, the retaining portion 70 is circumferentially joined to an outside of the lower end of the trouser leg 22, and is separated into an upper cover 71 and a lower holding pocket 72. The upper cover 71 downwardly covers the pocket opening of the lower holding pocket 72, thereby preventing items stored within the lower holding pocket 72 from getting drenched by the rain.

The extension portion 40 is of cylindrical form, a top end of which is enclosed within the lower holding pocket 72, and enables the extension portion 40 to downwardly extend from the lower end of the trouser leg 22. Furthermore, the connecting portion 50 is attached to the lower end of the extension portion 40.

Referring to FIGS. 3 and 4, when needed, the extension portions 40, the connecting portions 50 and the shoe coverings 60 are pulled out directly from within the lower holding pockets 72, whereafter the extension portions 40 and the connecting portions 50 are put on over the legs of the user, and the feet are then slipped into the shoe coverings 60 through the openings 62, thereby completely covering the legs and feet of the user.

Figure 6:
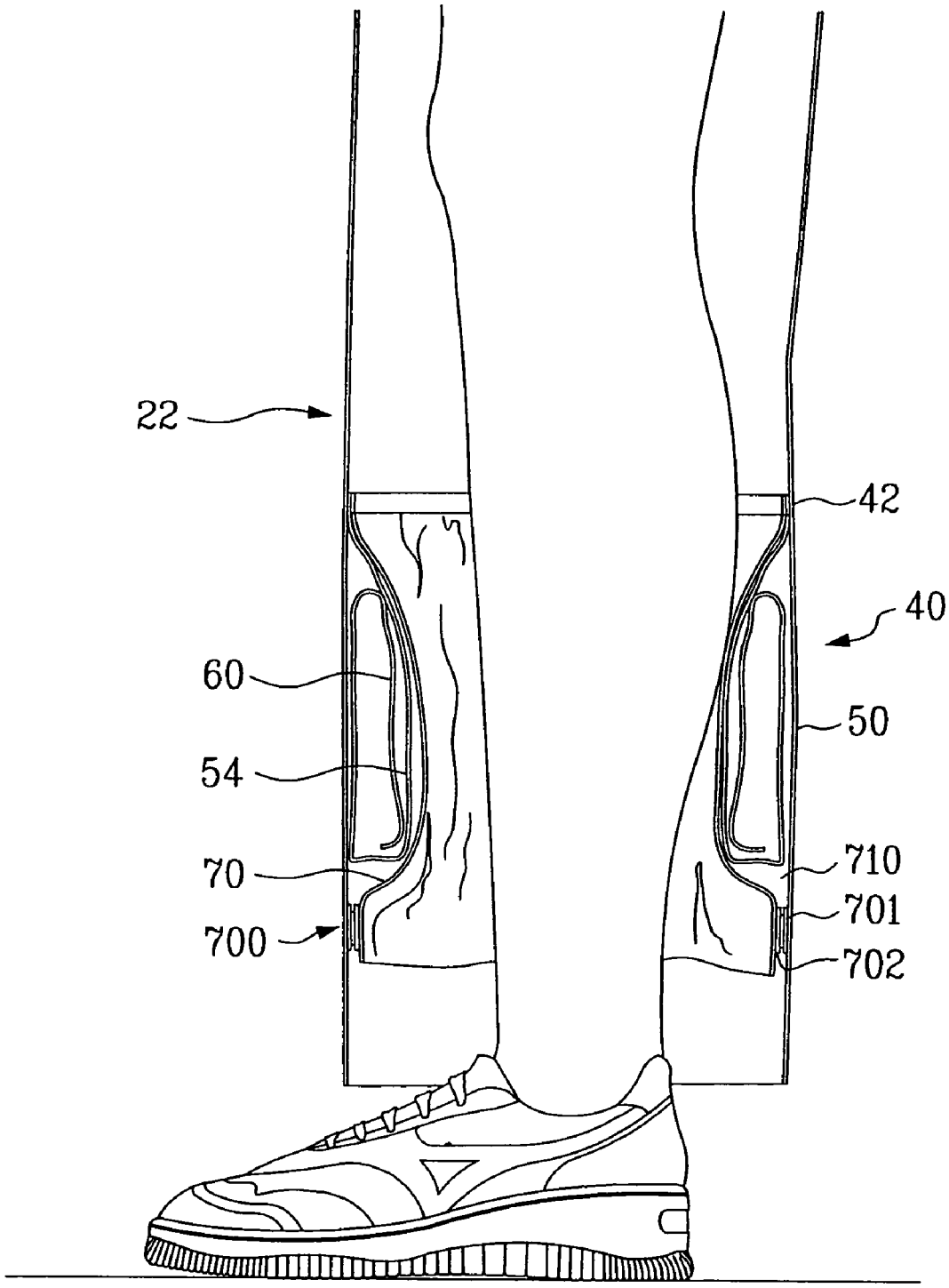
FIG. 6 shows a structural schematic view of a second embodiment depicting the shoe covering after being retained within the retaining portion according to the present invention.
Figure 7:
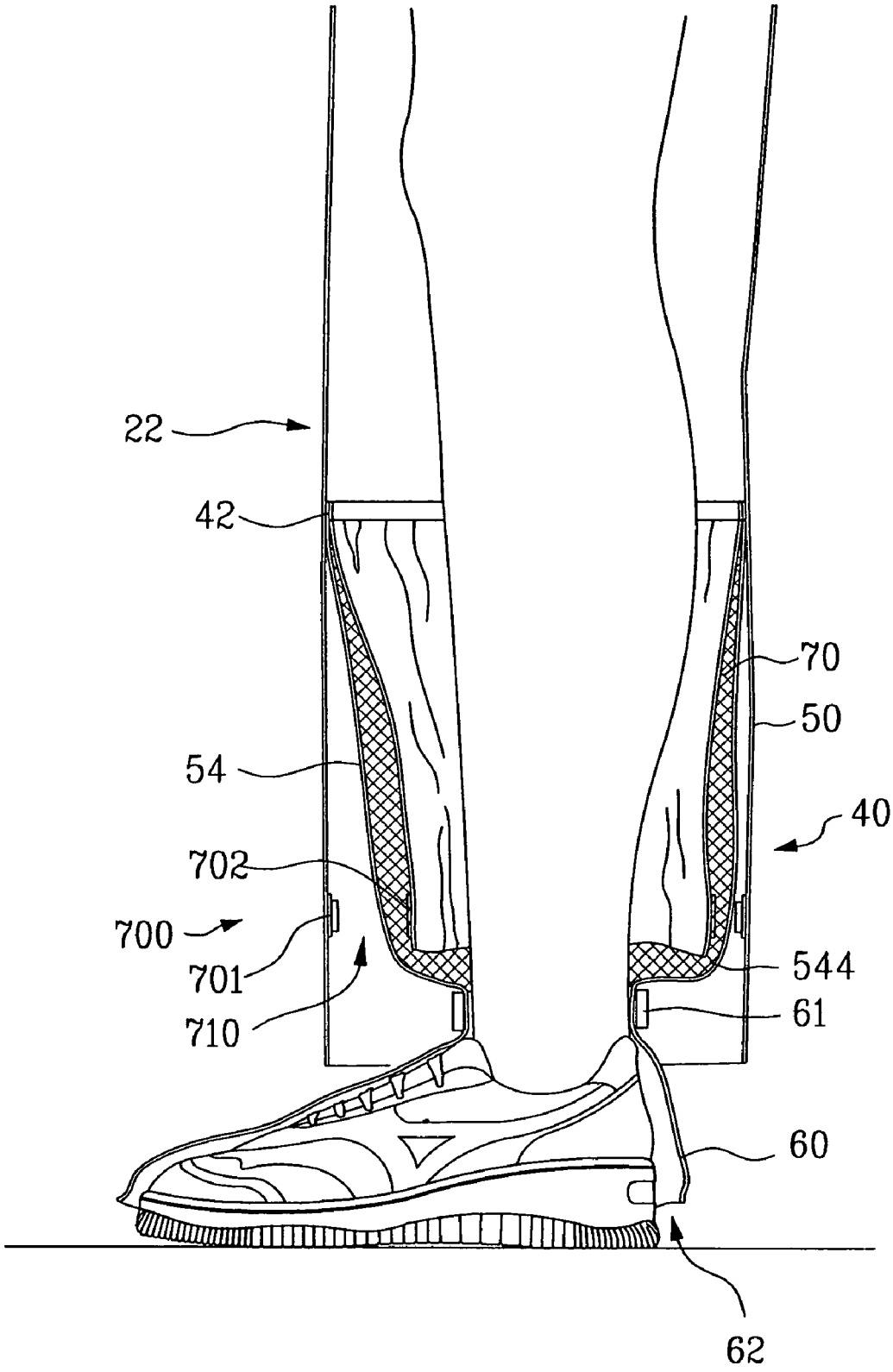
FIG. 7 shows a structural schematic view of the second embodiment depicting the shoe covering after being removed from the retaining portion according to the present invention.

Referring to FIGS. 6 and 7, which show a second embodiment of the present invention, wherein the connecting portion 50 is attached to an appropriate position of a lower portion of the trouser leg 22, and a periphery of the retaining portion 70 forms a covering. The retaining portion 70 is annular joined to an inner periphery of the connecting portion 50, and a retaining space is formed between the retaining portion 70 and the trouser leg 22. A fixing portion 700 is attached to the retaining portion 70 close to a retaining opening 710. The extension portion 40 is disposed within the retaining space formed between the connecting portion 50 and the retaining portion 70. The position fixing portion 42 is affixed to an appropriate position of the connecting portion 50 close to the knee of the user, and has the function to affix the retaining portion 70 to one end of the extension portion 40, thereby enabling another open end of the retaining portion 70 and the extension portion 40 to naturally hang.

The shoe covering 60 is joined to the lower end of the extension portion 40, and a bottom portion of the shoe covering 60 is designed with the opening 62, through which the shoe covering 60 and the extension portion 40 can be rolled up and then retained within the retaining portion 70, and the fixing portion 700 is used to close and secure the retaining opening 710, thereby preventing the retained extension portion 40 and the shoe covering 60 from hanging down and falling out the retaining opening 710. An embodiment of the fixing portion 700 can use first male fasteners 701 and first female fasteners 702, as depicted in FIG. 6.

When the shoe covering 60 is needed, the first male fasteners 701 and the first female fasteners 702 are unfastened, and then the extension portion 40 and the shoe covering 60 are pulled out from the retaining portion 70 through the retaining opening 710. After the extension portion 40 is put on the leg of the user, the foot of the user can then be placed into the shoe covering 60 through the opening 62.

Figure 8:
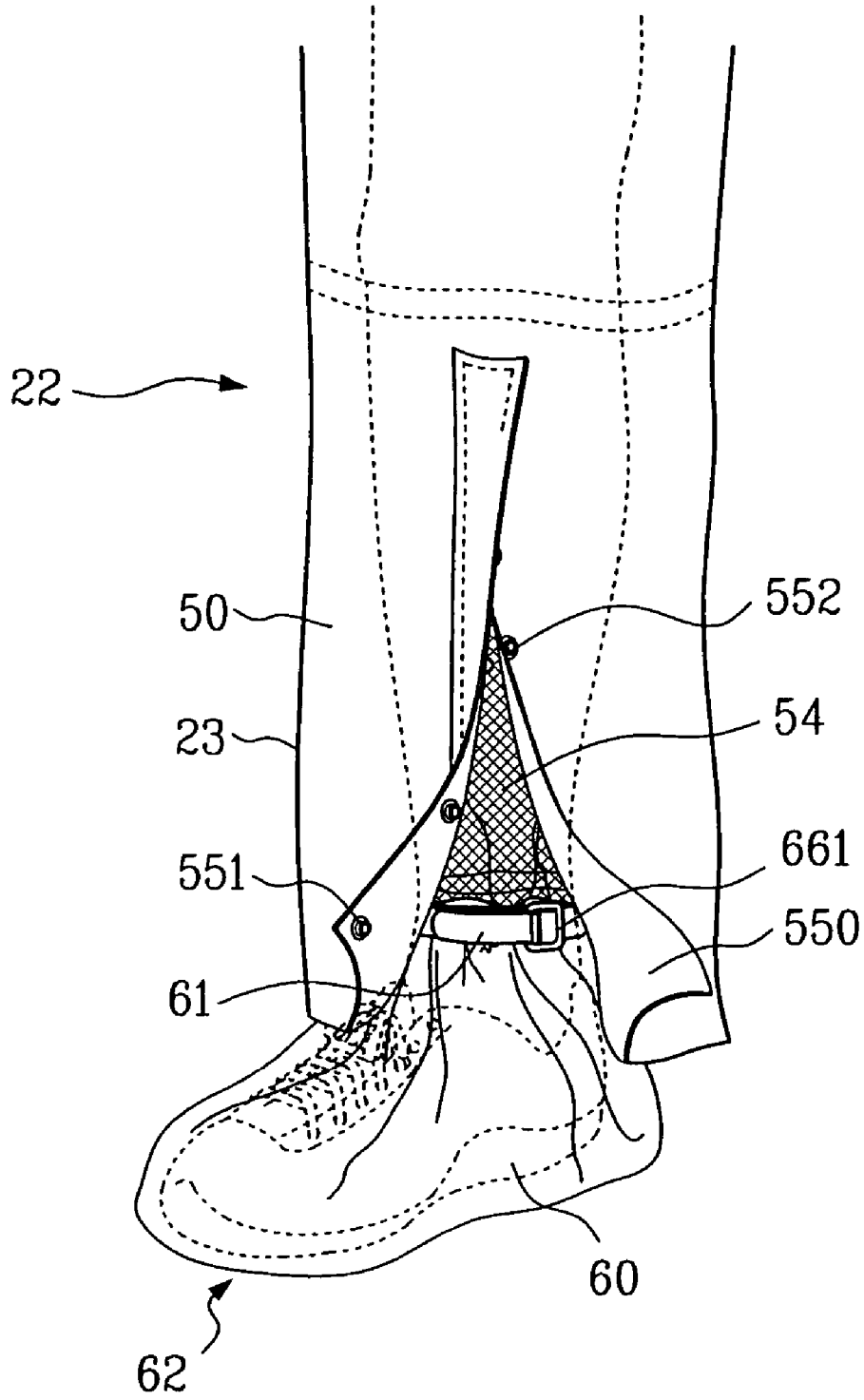
FIG. 8 shows a structural schematic view of the second embodiment depicting an open crossover portion being used when fitting on the present invention.
Figure 9:
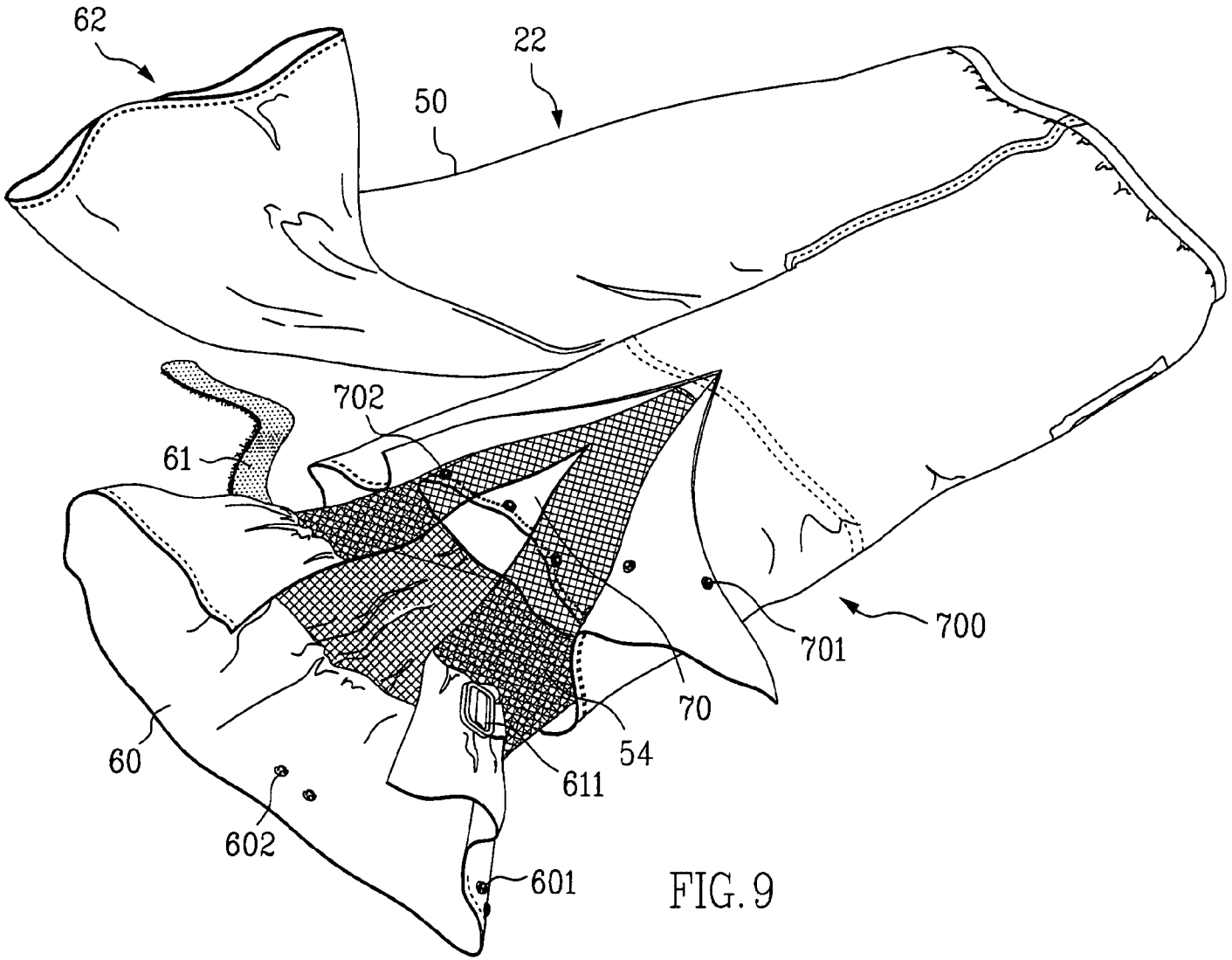
FIG. 9 shows a structural schematic view of the second embodiment depicting the open crossover portion in an open state according to the present invention.
Figure 10:
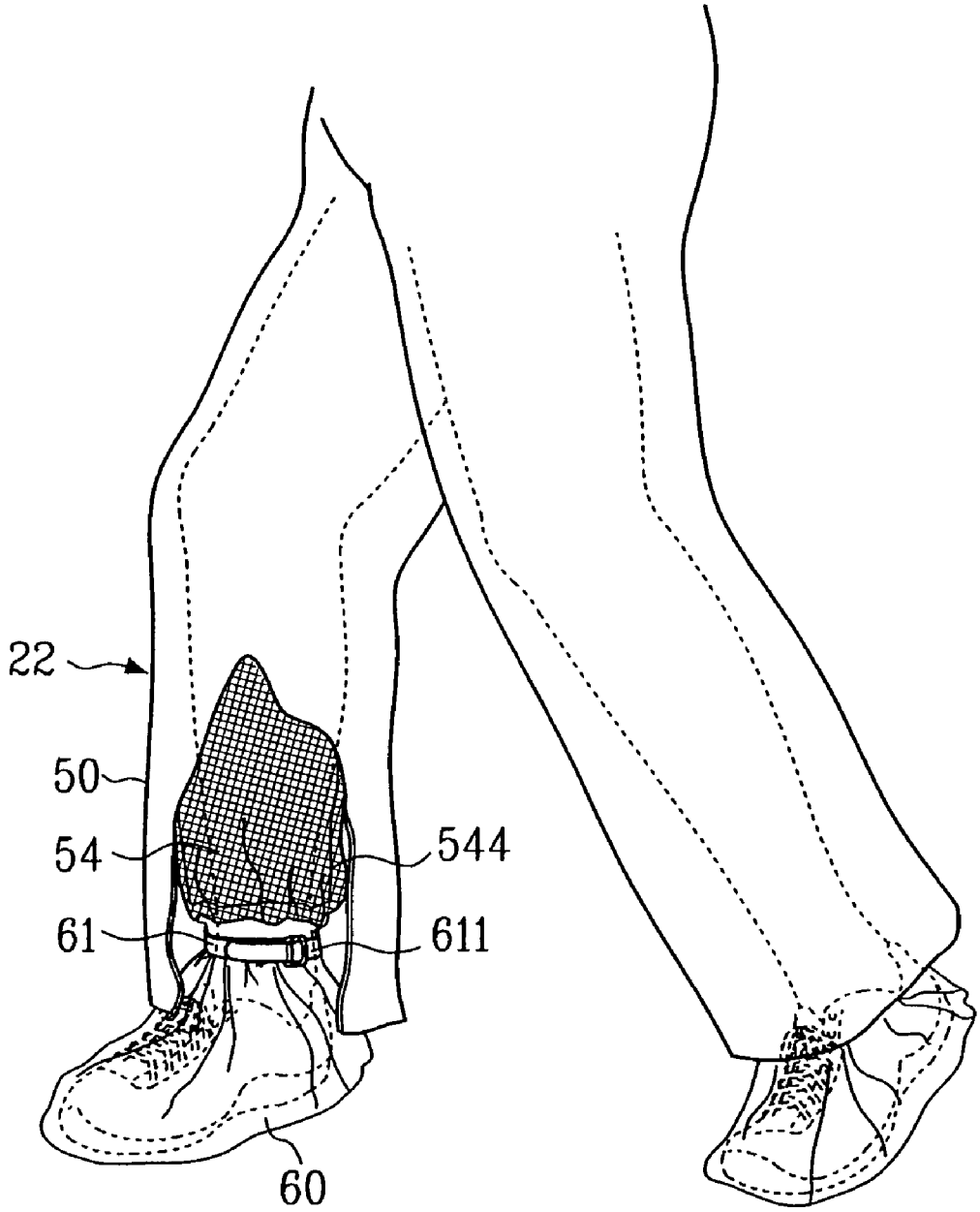
FIG. 10 shows a partial structural cutaway view of the second embodiment with the open crossover portion when a wearer of the present invention is walking.
Figure 11:
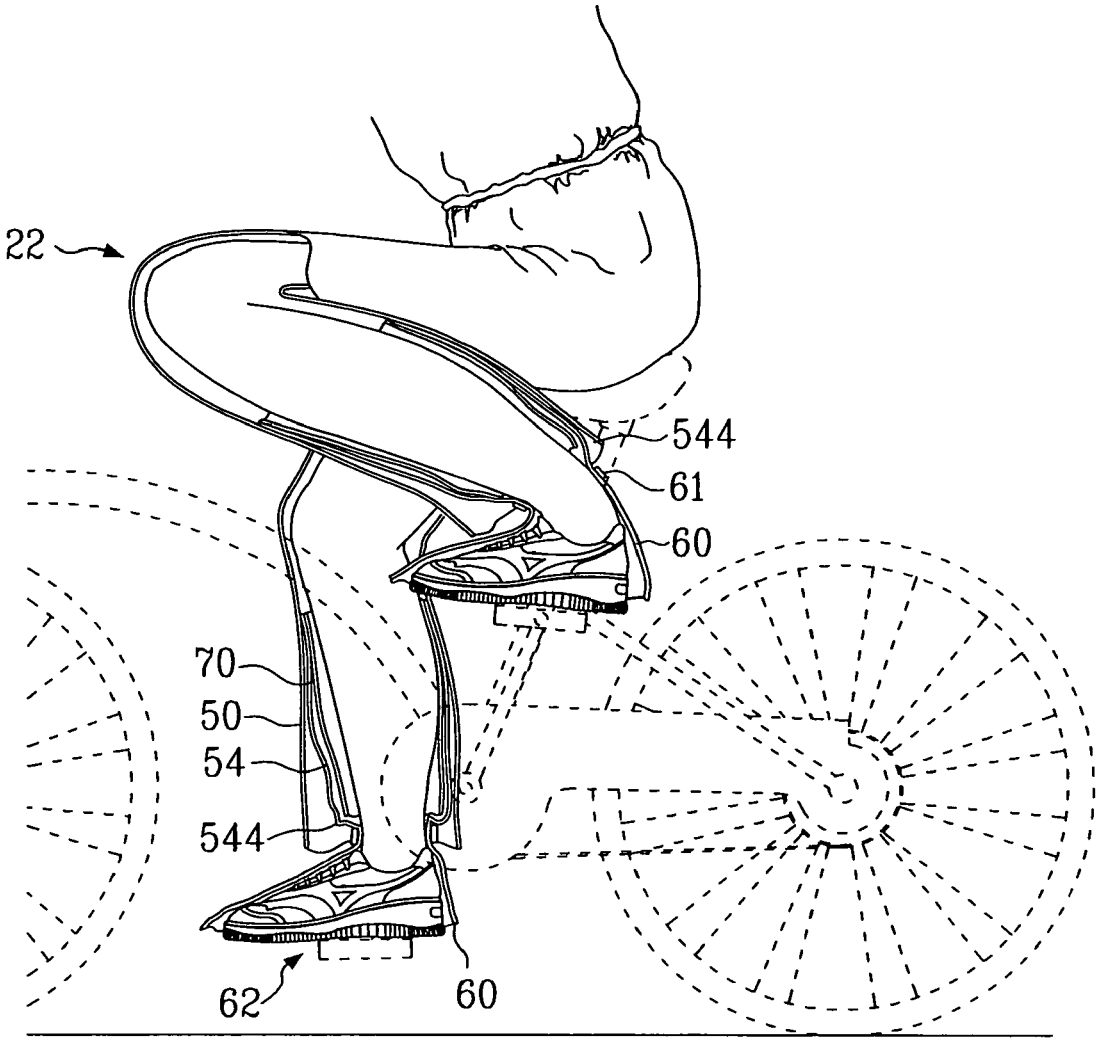
FIG. 11 shows a structural schematic view of the second embodiment with the open crossover portion when a wearer of the present invention is riding a bicycle.

Referring to FIGS. 7, 8, 9, 10 and 11, which show an embodiment of the extension portion 40 having a length slightly longer than the connecting portion 50, and uses a flexible soft lining 54. The position fixing portion 42 fixes the connecting portion 50 and the end of the retaining portion 70, and the retaining space is formed therebetween. A binding member 61 attached to a periphery of the shoe covering 60 and a binding component 611 are used to bind the shoe covering 60 tightly around the ankle position of the user, which thus joins the extension portion 40 to an upper portion of the shoe covering 60, and the flexible soft lining 54, being slightly longer than the connecting portion 50 forms a curved portion 544 that provides an allowance for displacement and extension of the legs of the user when wearing the shoe coverings 60. Such a unique structural design allows for unhindered large extending movements of the legs when wearing the shoe coverings 60 of the present invention, such as when walking quickly or even when riding a bicycle, as depicted in FIGS. 10 and 11, by using the allowances for displacement and extension of the legs provided by the curved portions 544. Because of the soft and light features of the soft lining 54, thus, the user is completely unaware of movement and change in the described structure of the present embodiment when moving his legs, thereby achieving comfort and flexibility regardless of whether the legs are in an extended or contracted state.

Referring to FIGS. 8 and 9, the connecting portion 50 can be further designed with an open crossover portion 550, wherein opening and closing of second male fasteners 551 and second female fasteners 552 attached to the open crossover portion 550 enable more convenient fitting and retaining of the shoe covering 60.

Referring again to FIG. 9, third male fasteners 601 and third female fasteners 602 are further attached to a periphery of the shoe covering 60 that are used to achieve the objective of being able to adjust the measurements of the shoe covering 60.

Figure 12:
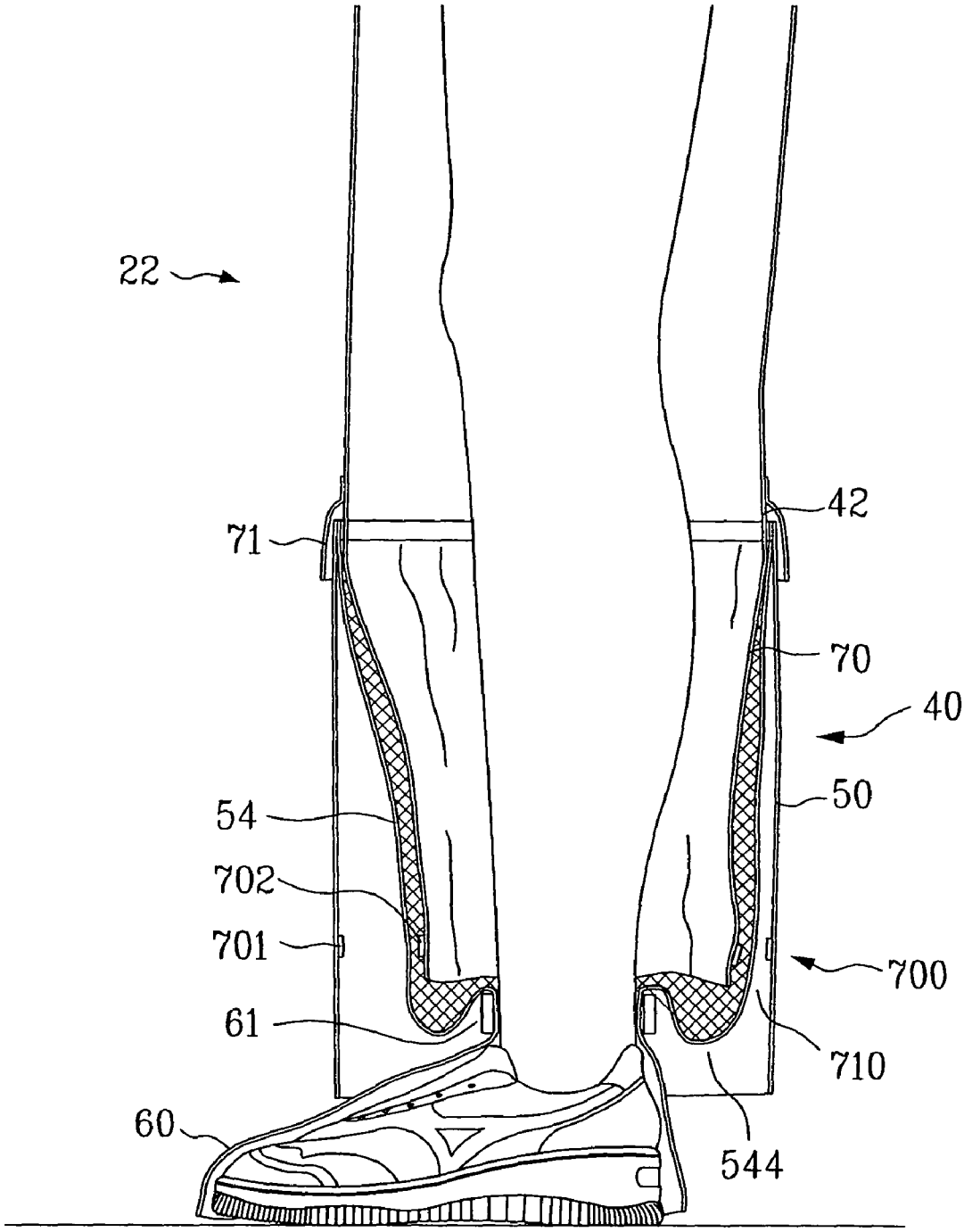
FIG. 12 shows a structural schematic view of a third embodiment depicting the show covering after being removed from the retaining portion and fitted on the leg of a user according to the present invention.
Figure 13:
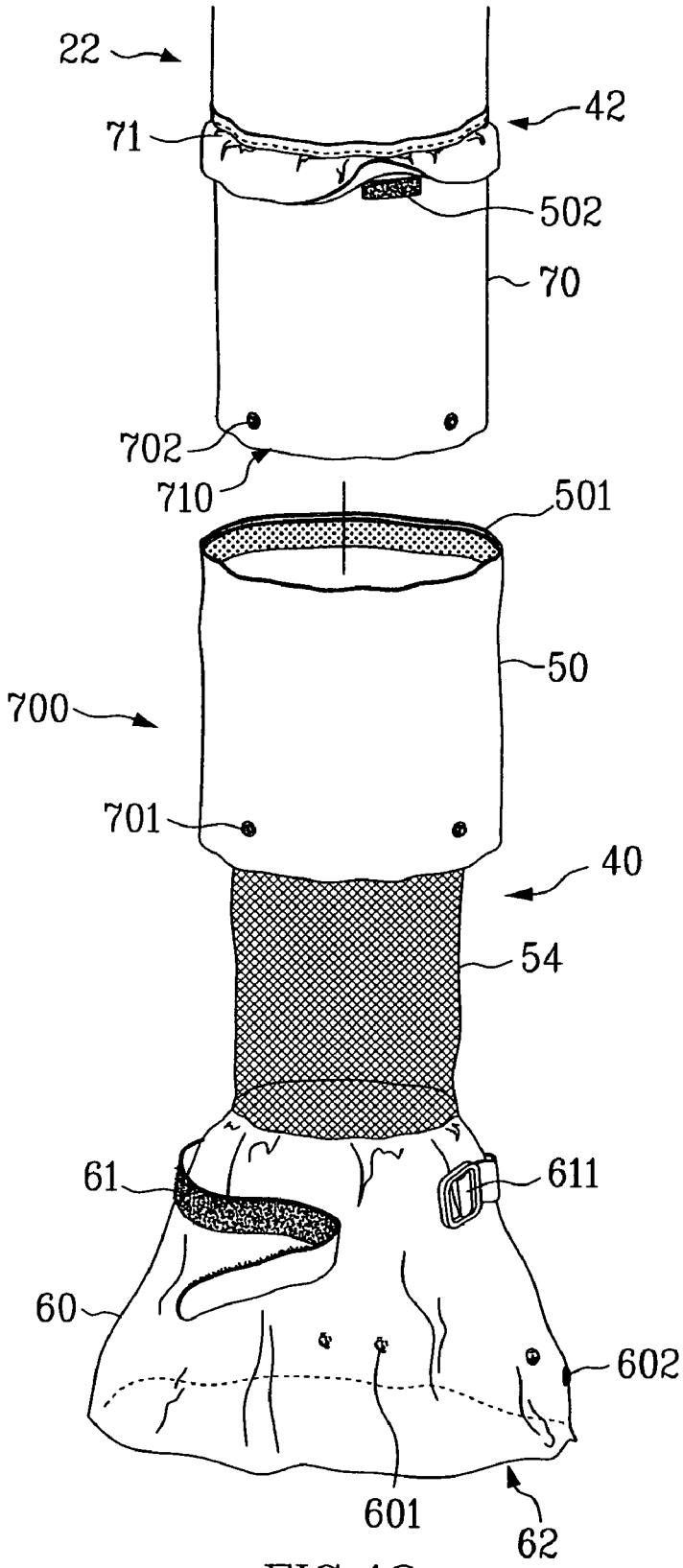
FIG. 13 shows a structural exploded schematic view of the third embodiment according to the present invention.
Figure 14:
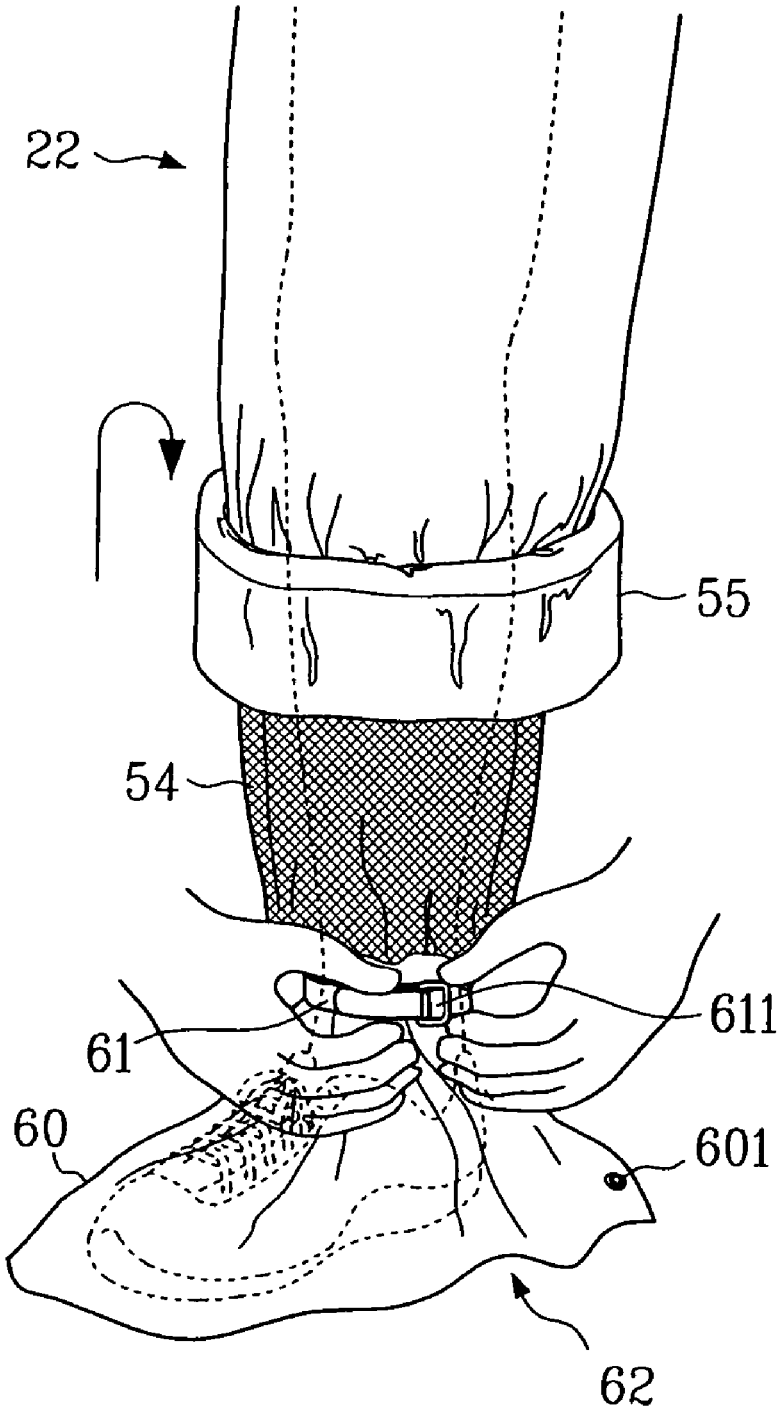
FIG. 14 shows a structural schematic view of the third embodiment depicting the shoe covering after being removed from the retaining portion and being fitted to the ankle of a wearer according to the present invention.

Referring to FIGS. 12, 13 and 14, which show a third embodiment of the present invention, wherein difference between the structure of this embodiment and the aforementioned second embodiment is in a movable join method used to join the connecting portion 50 and the extension portion 40 to a periphery of the retaining portion 70 at a position of the position fixing portion 42. The connecting portion 50 is fixed to an end of the extension portion 40. Fourth male fasteners 501 are attached to an inner periphery of the connecting portion 50, and fourth female fasteners 502 are attached to an outer periphery of the retaining portion 70 corresponding to a position close to the position fixing portion 42. The fourth male and female fasteners 501, 502 enable achieving the objective of movable joining the connecting portion 50, the extension portion 40 and the retaining portion 70. Embodiments of the male and female fasteners 501, 502 include structures using hook and loop fastening strips, buttons, and so on. The extension portion 40 of the present embodiment can also adopt the flexible soft lining 54 as described above for the second embodiment.

The position fixing portion 42 fixes the connecting portion 50 and the retaining portion 70, and the retaining space is formed therebetween. The binding member 61 attached to the periphery of the shoe covering 60 and the binding component 611 are used to bind the shoe covering 60 tightly around the ankle position of the user, which thus causes the flexible soft lining 54 joined to the upper portion of the shoe covering 60 to form the curved portion 544 that provides an allowance for displacement and extension of the legs of the user when wearing the shoe coverings 60.

The present embodiment uses a movable method to join the connecting portion 50 and the extension portion 40 to the retaining portion 70, and the gap formed at the movable joint may result in rain water entering therein, thereby annulling its effectiveness to achieve protection against rain. Hence, a flap 71 is additionally attached to the position fixing portion 42 at a position of the connecting portion 50, thereby covering the connecting portion 50 and the gap formed by the movable joining of the extension portion 40 and the retaining portion 70.

Because the present embodiment is not designed with the open crossover portion 550, as depicted in FIG. 8, thus, when needed, the first male and female fasteners 701, 702 attached to the fixing portion 700 are opened, and the connecting portion 50 is directly rolled upwards, then the soft lining 54 of the extension portion 40 is pulled out from the retaining opening 710 of the retaining portion 70, and the shoe covering 60 is fitted onto the foot through the opening 62, whereafter the binding member 61 and the binding component 611 are used to fix position of the shoe covering 60. Furthermore, the third male and female fasteners 601, 602 are used to adjust the measurements of the shoe covering 60.

Finally, the originally rolled-up connecting portion 50 is pulled down to neatly cover the soft lining 54 of the extension portion 40 and the shoe covering 60, thereby completing fitting of the shoe covering 60 onto the foot.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A connecting and retaining structure for a shoe covering and trouser leg, comprising a connecting portion, a retaining portion, an extension portion, a position fixing portion and a shoe covering, wherein the connecting portion and the extension portion are columnar sheets that are annular joined and fixed to an appropriate position of a trouser leg corresponding to the position fixing portion; the shoe covering is joined to a lower end of the extension portion and is designed with an opening, and the extension portion is a flexible soft lining to provide the shoe covering with an allowance for displacement and extension of the leg of a user extended from a lower end of the trouser leg, through which the shoe covering and the extension portion can be rolled up and then retained within the retaining portion; a fixing portion is attached to the retaining portion close to a retaining opening, thereby preventing the rolled up shoe covering and the extension portion from falling or dropping out of the retaining portion.

2. A connecting and retaining structure for a shoe covering and trouser leg, comprising a connecting portion, a retaining portion, an extension portion, a position fixing portion and a shoe covering, wherein the connecting portion and the extension portion are columnar sheets that are annular joined and fixed to an appropriate position of a trouser leg corresponding to the position fixing portion; the connecting portion is attached to a periphery of the retaining portion and forms a covering; the retaining portion is attached to an inner periphery of the connecting portion, and a retaining space is formed between the retaining portion and a trouser leg, moreover, a fixing portion is attached to the retaining portion close to a retaining opening; the fixing portion is attached to an appropriate position of the trouser leg and affixes the connecting portion, the retaining portion and an end of the extension portion; the shoe covering is joined to a lower end of the extension portion and is designed with an opening, and the extension portion is a flexible soft lining to provide the shoe covering with an allowance for displacement and extension of the leg of a user attached between the connecting portion and retaining portion, through which the shoe covering and the extension portion can be rolled up and then retained within the retaining portion, and the fixing portion is used to further fix position thereby preventing the rolled up shoe covering and the extension portion from falling or dropping out of the retaining portion.

3. The connecting and retaining structure for a shoe covering and trouser leg according to claim 1, wherein the shoe covering with opening at a bottom of the shoe covering assumes an open state.

4. The connecting and retaining structure for a shoe covering and trouser leg according to claim 2, wherein the shoe covering with opening at a bottom of the shoe covering assumes an open state.

5. The connecting and retaining structure for a shoe covering and trouser leg according to claim 1, wherein the fixing portion comprises a male fastener and a female fastener; after the male and female fasteners are mutually fastened, the retaining space formed between the connecting portion and the retaining portion enables the rolled up extension portion and shoe covering to be disposed therein.

6. The connecting and retaining structure for a shoe covering and trouser leg according to claim 2, wherein the fixing portion comprises a male fastener and a female fastener; after the male and female fasteners are mutually fastened, the retaining space formed between the connecting portion and the retaining portion enables the rolled up extension portion and shoe covering to be disposed therein.

7. The connecting and retaining structure for a shoe covering and trouser leg according to claim 1, wherein a binding member is attached to an outer periphery of the shoe covering to fix position of the shoe covering after fitting to the foot.

8. The connecting and retaining structure for a shoe covering and trouser leg according to claim 2, wherein a binding member is attached to an outer periphery of the shoe covering to fix position of the shoe covering after fitting to the foot.

9. The connecting and retaining structure for a shoe covering and trouser leg according to claim 1, wherein the connecting portion is designed with an open crossover portion, opening and closing of which is used to facilitate fitting and storing away of the shoe covering; second male fasteners and second female fasteners are further attached to the open crossover portion, and are used to achieve the objective to enable opening and closing of the open crossover portion.

10. The connecting and retaining structure for a shoe covering and trouser leg according to claim 2, wherein the connecting portion is designed with an open crossover portion, opening and closing of which is used to facilitate fitting and storing away of the shoe covering; second male fasteners and second female fasteners are further attached to the open crossover portion, and are used to achieve the objective to enable opening and closing of the open crossover portion.

11. The connecting and retaining structure for a shoe covering and trouser leg according to claim 1, wherein third male fasteners and third female fasteners are further attached to a periphery of the shoe covering, and are used to achieve the objective to enable adjusting the measurements of the shoe covering.

12. The connecting and retaining structure for a shoe covering and trouser leg according to claim 2, wherein third male fasteners and third female fasteners are further attached to a periphery of the shoe covering, and are used to achieve the objective to enable adjusting the measurements of the shoe covering.

13. The connecting and retaining structure for a shoe covering and trouser leg according to claim 1, wherein the connecting portion and the extension portion are joined to a periphery of the retaining portion at a position of the position fixing portion using a movable joint method.

14. The connecting and retaining structure for a shoe covering and trouser leg according to claim 2, wherein the connecting portion and the extension portion are joined to a periphery of the retaining portion at a position of the position fixing portion using a movable joint method.

15. The connecting and retaining structure for a shoe covering and trouser leg according to claim 13, wherein the connecting portion is fixed to an end of the extension portion, fourth male fasteners are attached to an inner periphery of the extension portion; and fourth female fasteners are attached to an outer periphery of the retaining portion at a position of the position fixing portion; the fourth male and female fasteners are used to achieve the objective of movable joining the connecting portion, the extension portion and the retaining portion.

16. The connecting and retaining structure for a shoe covering and trouser leg according to claim 14, wherein the connecting portion is fixed to an end of the extension portion, fourth male fasteners are attached to an inner periphery of the extension portion; and fourth female fasteners are attached to an outer periphery of the retaining portion at a position of the position fixing portion; the fourth male and female fasteners are used to achieve the objective of movable joining the connecting portion, the extension portion and the retaining portion.

17. The connecting and retaining structure for a shoe covering and trouser leg according to claim 13, wherein a flap is attached on top of the position fixing portion, and is used to cover a gap formed by the movable joining of the connecting portion, the extension portion and the retaining portion.

18. The connecting and retaining structure for a shoe covering and trouser leg according to claim 14, wherein a flap is attached on top of the position fixing portion, and is used to cover a gap formed by the movable joining of the connecting portion, the extension portion and the retaining portion.

* * * * *